US011412806B2

(12) United States Patent
Röschmann-Foudhaili et al.

(10) Patent No.: US 11,412,806 B2
(45) Date of Patent: Aug. 16, 2022

(54) PROTECTION HELMET WITH TWO MICROPHONES

(71) Applicant: Sennheiser electronic GmbH & Co. KG, Wedemark (DE)

(72) Inventors: Hatem Röschmann-Foudhaili, Hannover (DE); Jan Watermann, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 345 days.

(21) Appl. No.: 16/675,461

(22) Filed: Nov. 6, 2019

(65) Prior Publication Data

US 2020/0146388 A1 May 14, 2020

(30) Foreign Application Priority Data

Nov. 9, 2018 (DE) ..... 102018128062.9

(51) Int. Cl.
*A42B 3/30* (2006.01)
*A42B 3/08* (2006.01)

(52) U.S. Cl.
CPC . *A42B 3/30* (2013.01); *A42B 3/08* (2013.01)

(58) Field of Classification Search
CPC ..... A42B 3/30; A42B 3/08
See application file for complete search history.

(56) References Cited

U.S. PATENT DOCUMENTS 4,471,174 A * 9/1984 Nava ..... A42B 3/30 379/430
4,517,417 A * 5/1985 Murayama ..... H04R 1/08 379/430
5,136,657 A * 8/1992 Hattori ..... A42B 3/127 2/421
8,315,405 B2 * 11/2012 Bakalos ..... G10K 11/17885 381/71.6
9,775,396 B1 * 10/2017 Olivares Velasco ... G16H 40/67
9,866,932 B2 1/2018 Chang et al.
2013/0305437 A1 * 11/2013 Weller ..... A42B 3/221 2/422
2015/0373450 A1 * 12/2015 Black ..... H04R 1/1041 455/11.1

(Continued)

FOREIGN PATENT DOCUMENTS

EP 0 412 205 2/1991

*Primary Examiner* — Tajash D Patel
(74) *Attorney, Agent, or Firm* — Haug Partners LLP

(57) ABSTRACT

Protection helmets may include integrated communication systems to allow the wearer to communicate with other persons. In a very loud environment, a reduction of ambient noise may be helpful, for example, for improving wireless communication. An improved protection helmet includes a helmet shell, a chin guard, a first microphone mounted on the inside of the chin guard and facing the mouth of the wearer, a second microphone mounted on the outside, the upper side or the lower side of the chin guard and not facing the mouth of the wearer, an electronic noise reduction unit generating a difference signal between signals of the first and the second microphone, and at least one interface for outputting the difference signal. Ambient noise in the signal of the first microphone can be reduced with the signal of the second microphone.

15 Claims, 3 Drawing Sheets

(56) References Cited

U.S. PATENT DOCUMENTS

| | | | | |
|---|---|---|---|---|
| 2016/0037849 | A1* | 2/2016 | Shearman | H04N 5/2253 2/424 |
| 2016/0095376 | A1* | 4/2016 | Schrader | A42B 3/166 2/410 |
| 2017/0188646 | A1* | 7/2017 | Liang | G02B 27/0176 |
| 2017/0212723 | A1* | 7/2017 | Atarot | G06F 3/167 |
| 2020/0389748 | A1* | 12/2020 | Said | H04S 3/004 |

* cited by examiner

PROTECTION HELMET WITH TWO MICROPHONES

The present application claims priority from German Patent Application No. 10 2018 128 062.9 filed on Nov. 9, 2018, the disclosure of which is incorporated herein by reference in its entirety.

FIELD OF THE INVENTION

The invention relates to a protection helmet having two microphones for a communication system, wherein one of the microphones serves for the reduction of ambient noise, as well as a communication system for a protection helmet.

BACKGROUND

For protection helmets for motorcyclists, car racers, pilots, but also forestry workers or mountaineers, it is known to integrate or retrofit communication equipment to allow the wearer of the helmet to communicate with other people.

For example, EP 0 412 205 B1 describes a protective helmet with a hard outer shell and a protective pad on the inside, which has recesses for a radio equipment. The helmet is a so-called full-face helmet, i.e. it also has a chin guard with a chin pad. The radio equipment includes an electronic transceiver, a speaker, a power supply battery, a radio antenna and at least one microphone, which is housed on or in the neck or chin pad. The microphone is only intended to record the voice of the wearer of the safety helmet.

However, protective helmets are often used in a very noisy environment. Thus, U.S. Pat. No. 9,866,932 B2 describes an "electronic" protective helmet for noise compensation comprising a communication unit, multiple speakers and a plurality of microphones. Via the communication unit, the helmet can be connected with a mobile device, e.g. a smartphone, which generates control signals corresponding to the microphone signals to compensate for the ambient sound in the sound emitted through the speakers. The microphones include two ambient sound microphones that are located laterally on the inside of the helmet near a wearer's ears, and therefore near the speakers, as well as a speech microphone located in front of the wearer's mouth at the inside of the chin guard. The signals picked up by the ambient sound microphones are electronically inverted. The resulting anti-noise signals are used as compensation signals to reduce the ambient noise at the ear of the helmet wearer by means of Active Noise Canceling (ANC). However, the sound recorded in front of the mouth of the helmet wearer, which serves as a speech signal, is not influenced by the described noise compensation at the ear, and remains afflicted with loud ambient noise, so that the intelligibility of the communication is very impaired for the communication partner.

SUMMARY OF THE INVENTION

It is an object of the present invention to provide a protection helmet that allows for an effective reduction of ambient noise portions in the voice microphone signal, thus allowing the wearer to communicate more effectively (e.g. wirelessly). A further object is to provide a communication system that is suitable for retrofitting a protection helmet.

A protection helmet according to embodiments of the invention is disclosed. A communication system according to embodiments of the invention is also.

Further advantageous embodiments are disclosed.

A method for reducing noise in a microphone signal of a microphone that is located at the inside of a chin guard of a protective helmet, according to the invention, is disclosed.

BRIEF DESCRIPTION OF THE DRAWINGS

Further details and advantageous embodiments are shown in the drawings, showing in FIG. 1 a schematic sectional view of a protective helmet according to the invention.

DETAILED DESCRIPTION OF EMBODIMENTS OF THE INVENTION

Figure 1:
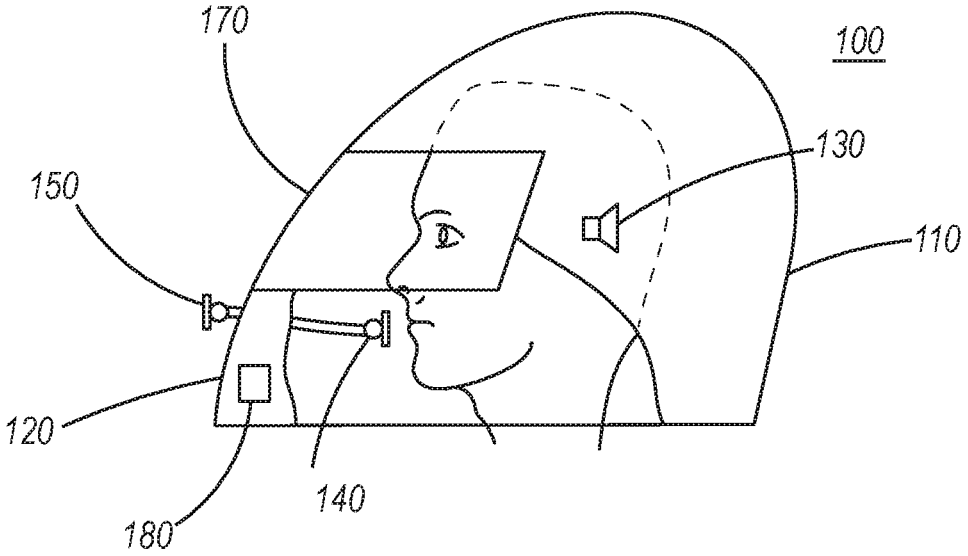

FIG. 1 shows exemplarily a schematic sectional view through a protective helmet 100, according to the invention. As usual, the protective helmet has a sturdy helmet shell 110 with a padding (not shown) as well as a chin guard 120 and a transparent visor 170. Optionally, at least one speaker 130 is located on the inside of the helmet shell 110 or in the padding such that it is close to an ear of a person wearing the helmet. Preferably, at least two optional speakers 130 are mounted near the ears, i.e. at least one speaker on each side. A first microphone 140 is provided on the inside 121 of the chin guard as a voice microphone. It is therefore facing the mouth of the person wearing the protective helmet. It may have directivity or be omnidirectional. Furthermore, at least one second microphone 150 is attached to another side of the chin guard 120 (on the outside 122, in this example). The second microphone does not need to face the mouth of the person wearing the helmet. It is used to acquire ambient sound to improve the voice microphone signal. It can also have directivity or be omnidirectional. Furthermore, the protective helmet includes an electronic circuit 180 for noise reduction which generates a difference signal between the signal of the first microphone or voice microphone 140 and the signal of the second microphone 150. The difference signal serves as a noise-reduced speech signal. Finally, the protective helmet contains at least one interface 160, such as e.g. an electrical connection or a radio unit, for outputting the difference signal. Via the interface 160, e.g. a wireless communication device can be connected to the noise-reduced speech signal, and possibly to the optional speaker 130. In addition, the protective helmet may include an electrical power supply, e.g. a battery to operate the wireless communication device and/or the electronic circuit 180. Alternatively, the power can also be supplied via the interface 160, if this is an electrical connection.

Figure 2:
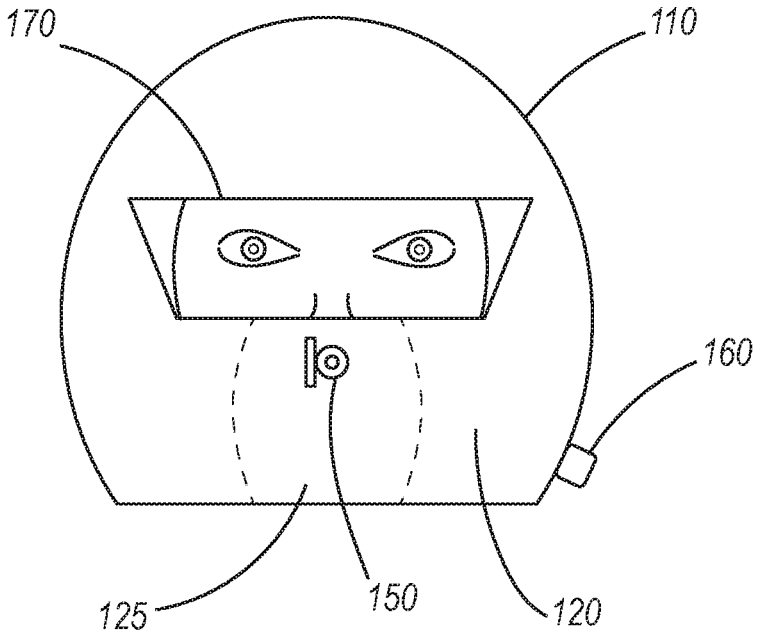
FIG. 2 a frontal view of a protective helmet according to the invention.

FIG. 2 schematically shows a frontal view of a protective helmet according to the invention. Fixed on the helmet shell 110 is the transparent and usually adjustable visor 170. Below the visor, about in front of the mouth of the person wearing the protective helmet, is an area 125 where—if possible, centrally—the second microphone 150 for acquiring ambient sound is located. The second microphone 150 should ideally be positioned centrally, but also deviations up to about 3 to 5 cm from the middle of the helmet may yield acceptable results. In an embodiment, the second microphone is an omnidirectional microphone, since the ambient sound has no special direction. In another embodiment, it is a microphone with a directional characteristic in the form of an eight (lying in FIG. 2, or standing), which reduces its sensitivity to the speech signal (see below). The interface 160 displayed as an electrical connector in FIG. 2 in this example is mounted outside the helmet shell 110, but may also be inside the helmet shell. E.g. it may be integrated into the padding as a wireless communication device, as known in the prior art. Particularly advantageous is the position of the at least second microphone 150 on the outside of the front of the protective helmet, in particular on a side of the chin guard 120 that is not the inside.

Figure 3:
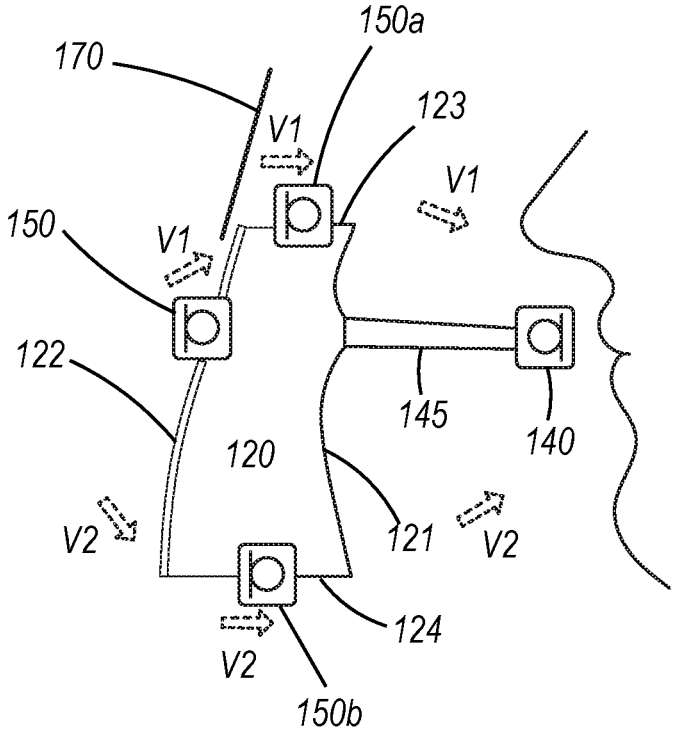
FIG. 3 a cross section through a chin guard with different possible microphone positions.

FIG. 3 shows an example of a cross section through a chin guard with various possible microphone positions. The chin guard 120 has an inside 121, an outside 122, an upper side 123 and a lower side 124. Various beveled areas are possible and are considered part of the outside, upper or lower side. The visor 170 may partially cover the outside 122, wherein usually vents are provided. The first microphone or voice microphone respectively 140 is positioned close (e.g., maximum 1 cm) to the mouth of the wearer, e.g. by using a fixture. Thus, the voice of the wearer may be acquired with a particularly high sound pressure, which is particularly advantageous in noisy environments. In order to record the still occurring disturbing ambience sound, the second microphone 150, 150*a*, 150*b* is attached to the chin guard, preferably in such a way that it does not face the mouth of the wearer. In a variant, the second microphone 150 is mounted on the outside 122 of the chin guard 120 and preferably oriented to the front, i.e. away from the wearer and the protective helmet altogether and against the first microphone 140. In another variant, the second microphone 150*a* is attached to the upper side 123 of the chin guard 120 and is preferably oriented substantially forwardly or upwardly. In a third variant, the second microphone 150*b* is attached to the lower side 124 of the chin guard 120 and also preferably oriented substantially forwardly or downwardly. However, if the second microphone 150, 150*a*, 150*b* is omnidirectional, its orientation is not relevant.

In any case, there is at least one acoustic connection between the first microphone 140 and the second microphone 150, even if a person is wearing the protective helmet. On the one hand, the disturbing noise arriving from the outside reaches the first microphone 140 via the acoustic connection. On the other hand, also the voice signal coming from the wearer reaches the second microphone 150 via the acoustic connection. For example, an acoustic connection V1 may lead from the outer second microphone 150—possibly under the visor 170—over the upper side 123 of the chin guard 120 to the first microphone 140. Another acoustic connection V2 may lead from the outer second microphone 150 under the chin guard to the first microphone 140. This at least one acoustic connection between the two microphones 140, 150 is important for both microphones to acquire as much as possible the same disturbing noise, or respectively for the coherence of noise portions from both microphones to be as high as possible. Only then "destructive interference" may occur, wherein the signal of the second microphone 150 (largely) eliminates the ambient sound portion in the signal of the first microphone 140. The disturbing sound is present as a diffuse sound field, so that the coherence decreases very rapidly with the distance. The invention is based on the recognition of the fact that, on the one hand, the acoustic connection V1, V2 should be as short as possible, e.g. 10 cm or 15 cm. The shorter the acoustic connection V1, V2 is, the higher is the coherence of the noise portions of the two microphone signals and the better can the disturbing noise portion acquired by the first microphone 140 be reduced. Therefore, it is particularly advantageous that the second microphone 150 is located at the chin guard 120 of the protective helmet.

On the other hand, the acoustic connection V1, V2 should be long enough for the second microphone 150, 150*a*, 150*b* to record as little as possible of the speech signal. Therefore, the first microphone 140 is positioned as close as possible in front of the mouth of the wearer of the protective helmet, e.g. using a fixture 145 such as a flexible boom arm. The device 145 may also be integrated into a chin protection pad on the inside 121 of the chin guard 120. In this way, the first microphone 140 makes use of the proximity effect, so that there is a clear difference between the speech signal and the interfering signal, e.g. about 30 dB. The difference may be additionally increased by selecting a proper directional characteristic for the second microphone 150, e.g. in the form of an eight. This has the advantage that the second microphone is less sensitive in the direction of the acoustic connection V1, V2 from which the speech signals of the wearer could arrive than for ambient sound. The farther away the microphones 140, 150 are from each other, the less speech acquires the second microphone 150, and the more appropriate is its signal for compensating or reducing ambient sound, respectively. The arrangement of the first and second microphones according to the invention, where the acoustic connection V1, V2 is between about 3 cm and 15 cm long, is here optimal for resolving these contradictory requirements.

The term "acoustic connection" means the shortest connection between two points that the sound may take. In particular, this may also be a direct point-to-point connection between the first microphone and the second microphone. In the case of a second microphone 150 being mounted to the front 121, it may be the shortest connection from the second microphone to the upper side 123, along the upper side 123 and from there directly to the first microphone 140.

The various possible positions shown in FIG. 3 for the second microphone 150, 150*a*, 150*b* offer various advantages. A second microphone 150 being mounted on the outside 122 acquires the ambient or disturbing noise particularly well, i.e. with a high sound pressure level. In addition, the acoustic damping of the helmet causes the speech signal to arrive at the second microphone 150 only at a very low level. In contrast, a second microphone 150*a* mounted on the upper side 123 of the chin guard 120 behind the visor 170 may well be shielded from wind noise. It may be directed forward, upward or diagonally forward and upward so as to reduce the level of the speech signal that it acquires. A second microphone 150*b* mounted on the lower side 124 of the chin guard 120 may also be well shielded from wind noise and, depending on the structure of the helmet, offer a particularly good acoustic connection to the first microphone 140. It is also possible to combine a plurality of second microphones 150, 150*a*, 150*b* mounted on the positions as described. Then, advantages of the different positions may complement each other. Further, there may be cases in which a second microphone, which in one embodiment is mounted on the inside 121 of the chin guard 120 (e.g. on the upper or lower edge, not shown in FIG. 3), is sufficiently far away from the first microphone 140 and simultaneously may acquire sufficient ambient noise from the outside, so that an effective noise reduction is possible also in this embodiment.

Figure 4A:
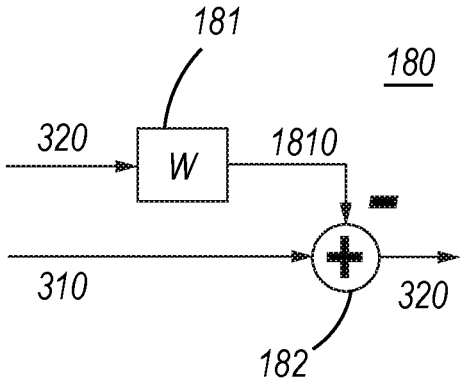
FIG. 4*a* a block diagram of a noise reduction unit.
Figure 4B:
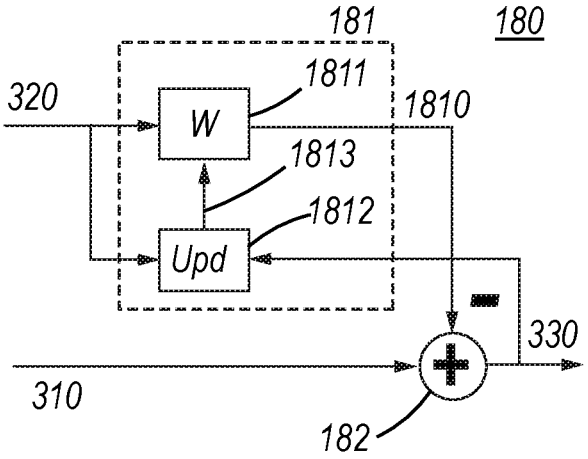
FIG. 4*b* a block diagram of a noise reduction unit with adaptive filtering.

The signals of the first and second microphones are combined in a noise reduction unit so as to reduce the ambient noise in the signal of the first microphone, or speech microphone 140 respectively, with the aid of the second microphone 150. The noise reduction unit 180 may be positioned e.g. in the padding of the helmet. In order to keep the sensitive leads as short as possible, it can be positioned in the chin guard 120 or chin guard pad, as shown in FIG. 1. FIG. 4 *a*) shows a block diagram of a noise reduction unit 180. Therein, a first microphone signal 310 is received from the first microphone 140. It is a speech signal superposed by ambient noise. A second microphone signal 320 received from one or more second microphones 150 essentially contains the ambient noise. It is filtered, e.g. by an adaptive filter 181, in order to compensate for known systematic differences in the ambient noise of the second microphone signal 320 with respect to ambient noise of the first microphone signal 310 (e.g. due to the construction). The adaptive filter 181 may emulate a linear relationship between the signals of the first and second microphones. E.g., a Least-Mean-Square (LMS) filter or a Recursive-Mean-Square (RMS) filter may be used as an adaptive filter, so that no previous knowledge about the transmission paths needs to be determined. The filtered ambient signal 1810 is subtracted from the first microphone signal 310 in a difference unit 182, so that a difference signal 330 results that corresponds to the noise reduced speech signal. It is easier to understand for the communication partner and therefore particularly well suited for telephony, voice radio etc. The adaptive filter 181 and/or the difference unit 182 may be implemented with one or more processors. The signals 310, 320 may already be digitized, that is to say have each gone through an analog-to-digital converter (not shown).

FIG. 4 *b*) shows details of an adaptive filtering, which is known as such. The adaptive filter 181 comprises the actual filter that performs filtering with a function W, as well as an adaptation block 1812 that determines or adapts the function W. For this purpose, the adaptation block 1812 receives the second microphone signal 320 and the difference signal 330 and calculates filter coefficients 1813 for the filtering 1811 such that the energy of the second microphone signal 320 is minimized in the difference signal 330. This effectively eliminates the second microphone signal 320 from the first microphone signal 310, and substantially only the desired speech portion of the first microphone signal 310 remains in the difference signal 330. This may be output e.g. to the communication partner.

Figure 5:
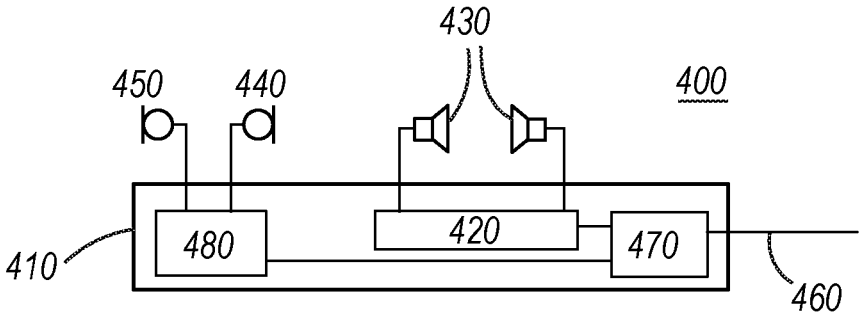
FIG. 5 a block diagram of a communication system.

In an embodiment, the invention relates to a communication system suitable for being mounted on or in a protection helmet. In a variant, it is suitable for advantageously retrofitting conventional protection helmets. FIG. 5 shows a block diagram of such communication system 400, which in this example comprises a first microphone or speech microphone 440, a second microphone or ambient sound microphone 450, one or more loudspeakers 430 and an electronic unit 410. The electronic unit 410 may comprise one or more processors, which implement for example an optional communication unit or amplifier unit 420, a signal processing unit 470 and a noise reduction unit 480. The latter may correspond to the above-described noise reduction unit 180. The two microphones 440, 450 are connected to the noise reduction unit 480 and may be aligned differently, as indicated in FIG. 5 and mentioned above. The signal processing unit 470 is electrically connected to the noise reduction unit 480 and may also comprise an external interface in order to connect 460 an external mobile communication device to the signal processing unit 470. The signal processing unit 470 may also be connected to the optional communication unit or amplifier unit 420, in order to provide it the signals to be reproduced via the optional loudspeakers 430. Instead of the loudspeakers 430, headphones or earphones may be provided that may be worn under the protection helmet. The interface may be e.g. an electrical connection or a radio module for a radio connection. Thus, the signal processing unit 470 may be connected e.g. to a smartphone with which the user may make telephone calls while wearing the protective helmet.

Figure 6A:
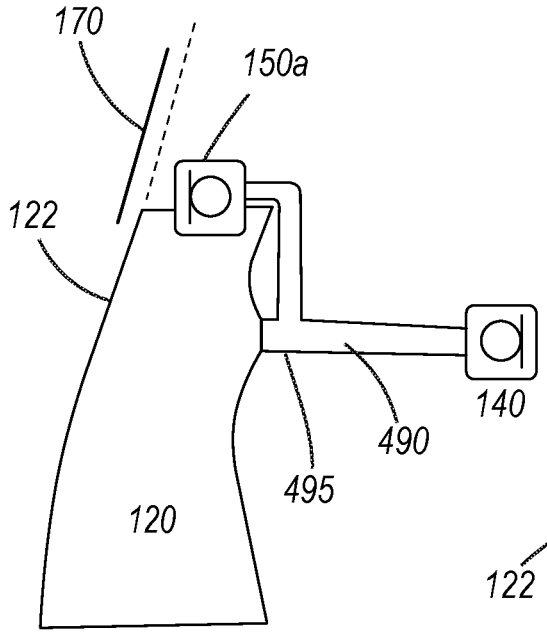
FIGS. 6*a* and *b* different embodiments of a mounting bracket for mounting microphones on a chin guard of a protective helmet.
Figure 6B:
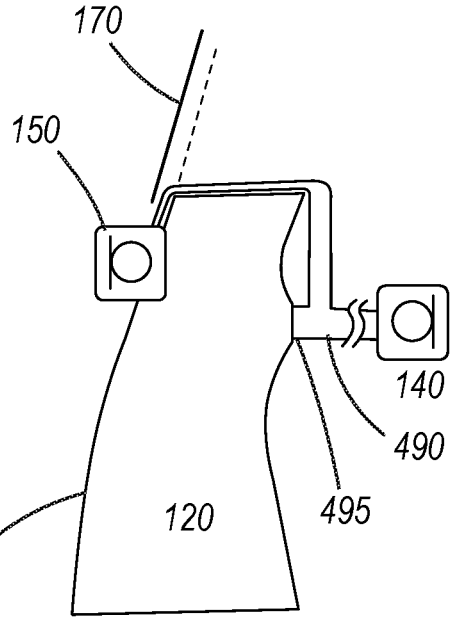

In an embodiment, there may also be provided a device for retrofitting a conventional protective helmet in accordance with the invention. For example, the first and the second microphone 140, 150 may be attached to a mounting bracket so that their relative position to each other is fixed, wherein the mounting bracket may be attached to the chin guard 120 of the protective helmet. FIG. 6 schematically shows various embodiments of a mounting bracket 490 for fastening microphones to the chin guard 120. In FIG. 6 *a*), the mounting bracket 490 has on its first end the first microphone 140 and on its second end a second microphone 150*a*, in order to position it on the upper side 123 of the chin guard 120. With the variant shown in FIG. 6 *b*), the second microphone 150 may be fastened at the outside 122 of the chin guard 120. On at least one location of the mounting bracket there may be a mounting 495, by which it may be attached to the chin guard 120 or chin guard pad (not shown). Connector cables for both microphones 140, 150 may run within the mounting bracket 490 and be connected by a cable (not shown) running within the chin guard or chin guard pad to the electronic circuitry of the noise reduction unit 180, 480.

Figure 7:
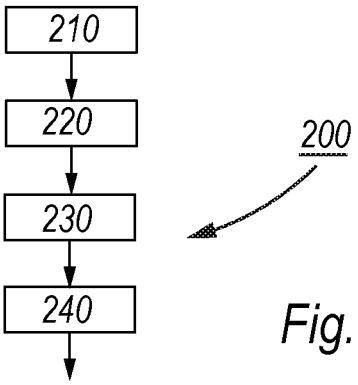
FIG. 7 a flow-chart of a method.

In an embodiment, the invention relates to a method for noise reduction in a microphone signal. A corresponding flow-chart is depicted in FIG. 7. It is a method 200 for noise reduction in a microphone signal 310 recorded by a first microphone 140 that is positioned on the inside 121 of a chin guard 120 of a protective helmet 100. The method comprises the following steps: recording 210 a reference signal 320 with a second microphone 150, filtering 220 the reference signal 320 by a filter 181, wherein a filtered reference signal 1810 is obtained, generating 230 a difference signal 330 between the microphone signal 310 acquired by the first microphone 140 and the filtered reference signal 1810, wherein the difference signal 330 represents a noise reduced microphone signal, and outputting 240 the noise reduced microphone signal. The second microphone 150 is located on the outside 122, the upper side 123 or the lower side 124 of the chin guard 120.

In the above description, it is to be noted that the terms "disturbing noise", "ambient noise" or "ambient sound" respectively, and similar terms are used synonymously.

The invention makes electronic communication, e.g. via telephone or voice radio, easier for wearers of protective helmets. In particular, speech signals may be better understandable for their communication partners, or for listeners/viewers in the case of a TV broadcast of a race, than those recorded with conventional communication systems or protective helmets respectively.

Of course, the various embodiments mentioned can be combined with each other, even if such combination is not expressly mentioned.

The invention claimed is:

1. A protection helmet, comprising:

a helmet shell;

a chin guard with an inside surface, an outside surface, an upper side and a lower side;

a first microphone mounted on the inside surface of the chin guard and facing a mouth of a person wearing the protection helmet;

a second microphone mounted on the outside surface, the upper side or the lower side of the chin guard and not facing the mouth of the person wearing the helmet;

an electronic noise reduction unit adapted for generating a difference signal between first signals of the first microphone and second signals of the second microphone; and at least one electronic interface for outputting the difference signal.

2. The protection helmet according to claim 1, further comprising:

a device configured for positioning the first microphone closer in front of the mouth of the person wearing the helmet.

3. The protection helmet according to claim 1, wherein the electronic noise reduction unit comprises at least one processor implementing an adaptive filter and a difference unit, and wherein the adaptive filter filters the second signals and the difference unit generates the difference signal.

4. The protection helmet according to claim 1, wherein the second microphone is mounted on the outside surface of the chin guard.

5. The protection helmet according to claim 1, wherein the second microphone is mounted on the lower side of the chin guard.

6. The protection helmet according to claim 1, further comprising a visor, wherein the second microphone is mounted on the upper side of the chin guard behind the visor.

7. The protection helmet according to claim 1, wherein the second microphone is mounted substantially centrally on the chin guard.

8. The protection helmet according to claim 1, wherein an acoustic connection exists between the first and second microphone while the protection helmet is worn by a person, and wherein the acoustic connection has a length between 3 cm and 15 cm for sound coming from outside.

9. The protection helmet according to claim 1, wherein the second microphone has an omnidirectional directivity pattern.

10. The protection helmet according to claim 1, wherein the second microphone has a directivity pattern in the form of an eight.

11. A communication system suitable for being mounted on or in a protection helmet, comprising:

a first microphone for mounting on an inside surface of a chin guard of the protection helmet;

a second microphone for mounting on an outside surface, the upper side or the lower side of the chin guard;

an electronic unit comprising a noise reduction unit; and an interface for connecting an external mobile communication device to the noise reduction unit;

wherein the noise reduction unit is connected to the first and second microphone and is adapted for generating a difference signal between a signal coming from the first microphone and a signal coming from the second microphone, and for providing the difference signal to the interface.

12. The communication system according to claim 11, wherein the first microphone and the second microphone are attached to a common mounting bracket that is configured for mounting on the chin guard of the protection helmet.

13. The communication system according to claim 11, wherein if the communication system is attached to a protection helmet and a person is wearing the protection helmet, an acoustic connection that is between 3 cm and 15 cm long exists between the first and the second microphone.

14. The communication system according to claim 11, further comprising:

at least one loudspeaker that is mountable within the protection helmet, or a headphone or earphone that is wearable under the protection helmet.

15. A method for noise reduction of a microphone signal recorded by a first microphone, wherein the first microphone is located on an inside surface of a chin guard of a protection helmet, comprising:

recording a reference signal with a second microphone located on an outside surface, the upper side or the lower side of the chin guard of the protection helmet;

filtering the reference signal with a filter, wherein a filtered reference signal is obtained;

generating a difference signal between the microphone signal and the filtered reference signal, wherein the difference signal represents a noise reduced microphone signal; and outputting the noise reduced microphone signal.

* * * * *